US009022136B2

(12) United States Patent
Tate

(10) Patent No.: US 9,022,136 B2
(45) Date of Patent: May 5, 2015

(54) APPARATUS AND METHOD RELATING TO FENCING

(75) Inventor: Rodney James Tate, Cotton Tree (AU)

(73) Assignee: Feral Pty Ltd. (AU)

( * ) Notice: Subject to any disclaimer, the term of this patent is extended or adjusted under 35 U.S.C. 154(b) by 508 days.

(21) Appl. No.: 13/202,147

(22) PCT Filed: Feb. 18, 2010

(86) PCT No.: PCT/AU2010/000180

§ 371 (c)(1),
(2), (4) Date: Jan. 16, 2012

(87) PCT Pub. No.: WO2010/094070

PCT Pub. Date: Aug. 26, 2010

(65) Prior Publication Data

US 2012/0112149 A1 May 10, 2012

(30) Foreign Application Priority Data

Feb. 18, 2009 (AU) ..... 2009900674

(51) Int. Cl.

| | |
|---|---|
| ***E04H 17/26*** | (2006.01) |
| ***B65H 49/32*** | (2006.01) |
| ***B65H 57/16*** | (2006.01) |

(52) U.S. Cl.

CPC ..... *E04H 17/261* (2013.01); *B65H 49/32* (2013.01); *B65H 57/16* (2013.01); *B65H 2701/3912* (2013.01)

(58) Field of Classification Search

CPC ..... E04H 17/02; E04H 17/26; E04H 17/261; E04H 17/263; E04H 17/266

USPC ..... 256/1, 32, DIG. 5; 173/46

See application file for complete search history.

(56) References Cited

U.S. PATENT DOCUMENTS

| | | | | |
|---|---|---|---|---|
| 303,263 | A * | 8/1884 | Burton | 256/DIG. 5 |
| 3,079,129 | A * | 2/1963 | Hulburt | 254/29 R |
| 3,877,140 | A * | 4/1975 | Topolsek | 256/19 |
| 3,934,655 | A | 1/1976 | Whistle | |
| 6,158,923 | A | 12/2000 | Wheeler et al. | |
| 6,412,236 | B1 * | 7/2002 | Johnson | 256/32 |
| 6,938,703 | B2 * | 9/2005 | Herrmann | 173/46 |
| 7,004,262 | B1 * | 2/2006 | Voichoskie et al. | 173/46 |

FOREIGN PATENT DOCUMENTS

| | | | |
|---|---|---|---|
| AU | 19237/88 | A | 1/1989 |
| FR | 2681627 | A1 | 3/1993 |
| FR | 2689556 | A1 | 10/1993 |
| GB | 2445753 | A | 7/2008 |

* cited by examiner

*Primary Examiner* — Michael P Ferguson

(74) *Attorney, Agent, or Firm* — Renner Kenner Greive Bobak Taylor & Weber

(57) ABSTRACT

An apparatus and method for fencing in which a mobile apparatus has a plurality of posts held with wires passing through respective aligned holes and means to take a post at a time to an into the ground driver with the wire or wires still extending through apertures in the post.

11 Claims, 12 Drawing Sheets

APPARATUS AND METHOD RELATING TO FENCING

This invention relates to a method for fencing and an apparatus to assist in fencing as well as an end result of a fence constructed by using the apparatus or according to the method.

BACKGROUND OF THE INVENTION

It is well known to construct long fences where individual posts are positioned in the ground, and wire is then consecutively connected to each post.

In current practice of constructing such a fence, the procedure includes embedding a plurality of spaced apart posts in the ground, then stringing wire whether there is plain wire or barbed wire or otherwise by anchoring at one end and then capturing at appropriate locations of that strung wire at a common height for each post along the length of the fence to be constructed.

Currently, such a construction technique involves repeated passage of workers along the length of the to be constructed fence and eventually tying each of perhaps three or four strands respectively at each of selected heights with respect to each of the posts and passing wire by hand through predrilled holes in wooden posts where these are used.

This current method is accordingly quite simply very time consuming and labour intensive and therefore relatively expensive.

The problem to which I am addressing this invention therefore relates to current potentially higher costs of erecting fences and ancillary to this is the time therefore taken to construct a fence and finally, I am in addition addressing a useful improvement which will be of advantage in relation to fences.

SUMMARY OF THE INVENTION

Considering the above, one form of the invention could be said to reside in a mobile apparatus for assisting and building a fence, the apparatus having a support frame, a spool of wire carrier supported by the support frame, a post support station on the support frame arranged to support a plurality of posts with each post being adjacent one to the other and in generally a parallel alignment to each other, each post having at least one hole through the respective post, the support station arranged to hold each post so that at least one hole of each post is in a location relative to an adjacent post which allows for a matching location so that said holes are mutually aligned, a length of wire, a portion of which length of wire being wound as a spool and carried by the spool of wire carrier and a further portion of the wire extending from the spool passing through collectively each of the aligned holes of the posts, and means to move each post in turn, with a portion of the wire still positioned through a respective aperture in the post, into an "into-the-ground" driving station.

In preference, at least one of the posts is of generally U shape in cross section along at least most of its length.

In a further embodiment at least one of the posts is of generally U shape in cross section.

In a further preferred arrangement at least one of the posts is of channel shape with sides defining the channel shape being flared to facilitate nesting of one such post into a second of such posts.

In preference where the post is a channel shape, there are a plurality of apertures in a back of the channel shape which are spaced apart along a direction of elongation of the channel shape.

In an alternate preference, where the post is a star dropper, a one of the flanges of the star cross-sectional shape extends out further from a centre of the star dropper than the other two flanges and it is through this larger flange that an aperture for the purposes of this invention is located.

In preference, there is more than one aperture in a respective post and there is correspondingly a spool of wire associated each with a respective set of holes.

In preference there is a roller associated with each length of wire and positioned subsequent to a wires passage through aligned holes in respective post and adapted and supported be means whereby to guide the wire passing out therefrom, and further adapted to retract from an engaging with—the—wire position when a post is being drawn past it prior to being positioned in a ground embedding station whereafter the roller will revert to a wire guiding position prior to the said post being caused to be inserted into the ground.

In preference each aligned set of apertures has a conduit passing therethrough to facilitate the passage of wire therethrough, to keep the holes aligned and to protect any protective coating on the edges of respective holes in the posts.

In an alternate form of this invention it can be said to reside in a method of assisting and building a fence which includes a mobile apparatus having a support frame, spool of wire carriers supported by the support frame, a post support station supported on the support frame and arranged to support a set of posts with each post in the set being adjacent one to the other and being supported so that an aperture through each post is mutually aligned with other apertures in adjacent posts, and there is a length of wire extending from a spool supported by a spool of wire carrier which extends through the mutually aligned apertures of the respective posts, the method including the steps of moving a post from the post support station to an insertion station, effecting an insertion of the post into the ground while the wire or wires remain threaded through the respective aperture or apertures of the post, and then moving the mobile apparatus to a next post insertion location.

In preference, there is a common conduit extending mutually through the aligned apertures in the respective posts.

This has the advantage of protecting each aperture from wear where the passage of the wire through the hole as it feeds out, could otherwise damage protective coatings such a zinc galvanising.

It also has the advantage of maintaining alignment of the posts.

In an alternate arrangement however, it is envisaged that there could be collars within each aperture which can be separable from other collars and that these collectively in an end to end alignment can provide a similar protective effect and subsequently provide if comprised of insulating material, insulation for the wire in an electrical sense where the wires may subsequently be electrified as in an electric fence concept.

One of the advantages of the arrangement thus far described is that the wire or wires can pass relatively uninhibited through the respective apertures through the post.

This has some advantages in relation to some fence applications where the stretch available from a long length of wire able to move relatively freely through respective apertures of posts means that the individual resistance to impact is a lot less.

This is considered to have some value where animals may accidentally or deliberately be impacted against the wires of the fence and if these are unduly rigid, then there is more potential for them to break or for the animal to be damaged.

By having a lot more resiliency because of the extended length over which any wire can stretch, means that this amount of give is kinder to any impacting animal.

Accordingly the invention can also reside in a fence constructed in accord with the said method or as a result of the use of the apparatus.

We have referred to wire in a general sense but it is to be understood that this can include any elongate material where for instance plastic monomers are available either in circular cross-sectional shape or as a tape and the term "wire" is intended to be read sufficiently broadly to incorporate any of these alternatives.

We have referred to a mobile apparatus and have envisaged that this can either be a static installation which can be loaded on for instance the tray of a truck, or it can be integrated as a trailer which can then be moved according to the method and description so far by a prime mover which may include a tractor or other motor driven apparatus.

In a further embodiment we propose that there is also a lifting apparatus so that sets of posts can be lifted into a position on a body for then subsequent use.

While in one embodiment there is described an arrangement by which the posts can be conveyed by a conveyor into a respective capture position for a front post, in another alternate form there is a post engager which is arranged to move to a post engaging position from time to time and in a controlled sequence engage a next to be acquired post and effect passage of this past the then retracted rollers and into the post ground embedding station.

A capture system is here preferably used to effect with an engagement with a respective post and once engaged to facilitate its release from a nesting position with other of the posts and being moved to the embedding station.

The ground embedding arrangement is adapted to effect on a sequenced basis insertion of the respective channel into the ground. In order to have this vertical the insertion apparatus is adapted to be adjusted so that it can be maintained in a vertical alignment even though its support frame is inclined.

One of the advantages of the described system is that the wires are being unwound from a spool in each case and it is proposed as a further aspect of this invention that they will be each subject to a selected minimum tension release so that wire as it is unwound is under such selected tension and such tension then can be maintained until the wire is anchored to a strainer post accepting that a previous strainer post has been located in the ground and is anchoring the wires to allow for such straining to a subsequent strainer post.

In a further preferred embodiment there is at least one strainer post that has a first ground embedded pin with one of more helically aligned flutes at or toward a lower end.

Further, with a strainer post being adapted to act as an anchor post there is further adapted to be a ground embedded pin with a strut engaging with the post to effect strengthening of the post.

In summary, and as an alternative I propose an apparatus which holds a plurality of posts in such a way that they can be fed one at a time into a "into the ground" driving station and that at least one strand of wire extends through apertures associated with posts stored for subsequent feed into the "into the ground" driving station. This then continues so that the wire strand continues to be positioned through an aperture in the post once the post has been driven into the ground.

In the alternative the posts have a commonly positioned aperture through a portion of the post and at least while in a storage position on the support frame, there is a conduit extending through either each of the apertures or the respective apertures of the posts through which the at least one strand of wire passes.

In preference, the apparatus is arranged to move relatively to the ground so as to proceed along a line where a fence is to be constructed, and the at least one strand of wire is fed from a coil of wire held by the apparatus and fed from the coil as the apparatus proceeds along the intended fence to be constructed line.

In the alternative, at least one of the posts is a stake having at least along one side a flange through which an aperture exists and through which the said at least one wire passes.

In preference, the posts are held in approximately parallel alignment with the at least one wire strand passing collectively through a one or more conduits which itself then passes through holes in the respective posts, there being means to guide the said strand from a rearward end of the post supporting station which is adapted to withdraw to allow a respective one of the posts to be drawn rearwardly into the "into the ground" driving station and once it has been driven into the ground, the wire guide means are arranged to collect the wire strand to guide this so that again it will be held approximately in alignment with wire emanating from the posts in the post holding station.

One of the issues is that hitherto, wire strands have been captured in relation to each post so that it becomes more difficult or impractical to tension a wire strand which passes through a plurality of the posts to which it is held.

In accordance with a further form of this invention, it is proposed that there is an aperture through which the wire strand is free to move in a lengthwise direction so that firstly, the apparatus as it is indeed feeding out and inserting into the ground each post, is also adapted to then establish and maintain tension appropriate to the fence or at least for the construction steps.

The apparatus therefore is provided as a mobile apparatus that can be driven or drawn with sufficient tension for the purpose and a coil or coils from which a wire strand is being unwound, is then caused to resist such unwinding to the extent that tension is detected.

It is found to be of advantage to provide from time to time, a stronger post as compared to other posts.

Such stronger post is then capable of providing an anchoring position and in preference, such an anchoring post can be secured by tethers including helical ground anchors which can be effected from the apparatus into a ground anchoring position from time to time.

With this invention facilitating the maintenance of tension in the wires and the location of posts in a ground inserted position, it becomes possible to pre-program the location of each post and also the alignment of the wires from time to time relative to the post alignments.

Tracking of a mobile apparatus can be achieved either by absolute means which can include directional measuring devices and means measuring a speed and distance of the mobile apparatus as it proceeds from point to point or in a further instance, a GPS system can be used to provide both orientation and absolute location.

There would be provided a computer program controlling a computer where there is an input from a GPS which in turn is used to direct and control the movement and location of a mobile apparatus and means to effect a stopping and starting and initiation of other portions of the apparatus to effect insertion into the ground at spaced apart location of posts.

With the apparatus using the principles previously described herein, it is a result that both the time and therefore costs associated with building and installing fences can be significantly reduced.

It is further anticipated that, whereas the number of persons that have historically been required to construct fences of the time envisaged need perhaps four or five persons, with the apparatus and method proposed, it is envisaged that this could be reduced to two where the persons directly monitor the apparatus and its operation and a second person can ensure a clear way ahead for the apparatus, collect supplies and from time to time relieve the operator on the apparatus.

In this specification reference is made to star droppers which can also be referred to as star pickets.

BRIEF DESCRIPTION OF THE DRAWINGS

For a better understanding of this invention, it will now be described with relation to embodiments thus far which shall be described with the assistance of drawings but it is to be clearly understood that it is not intended that the invention should be necessarily limited to any single feature or part of the embodiments which shall now be described according.

DESCRIPTION OF THE EMBODIMENTS AND DRAWINGS

Figure 1:
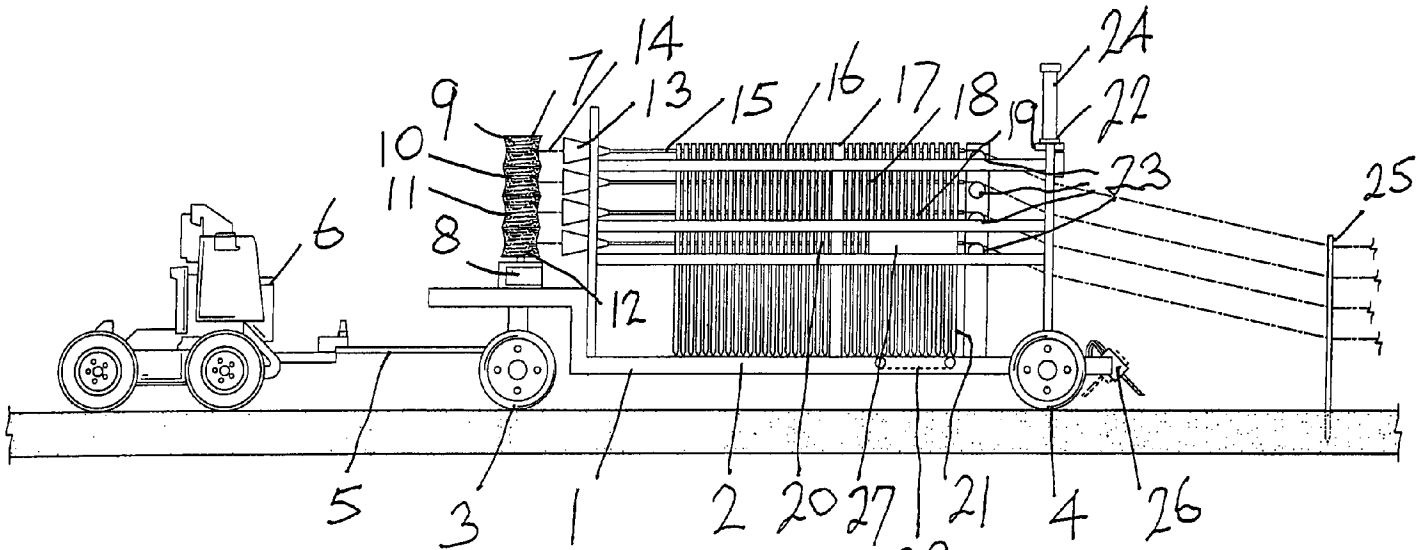
FIG. 1 is a side elevation of a mobile apparatus according to the first embodiment.
Figure 2:
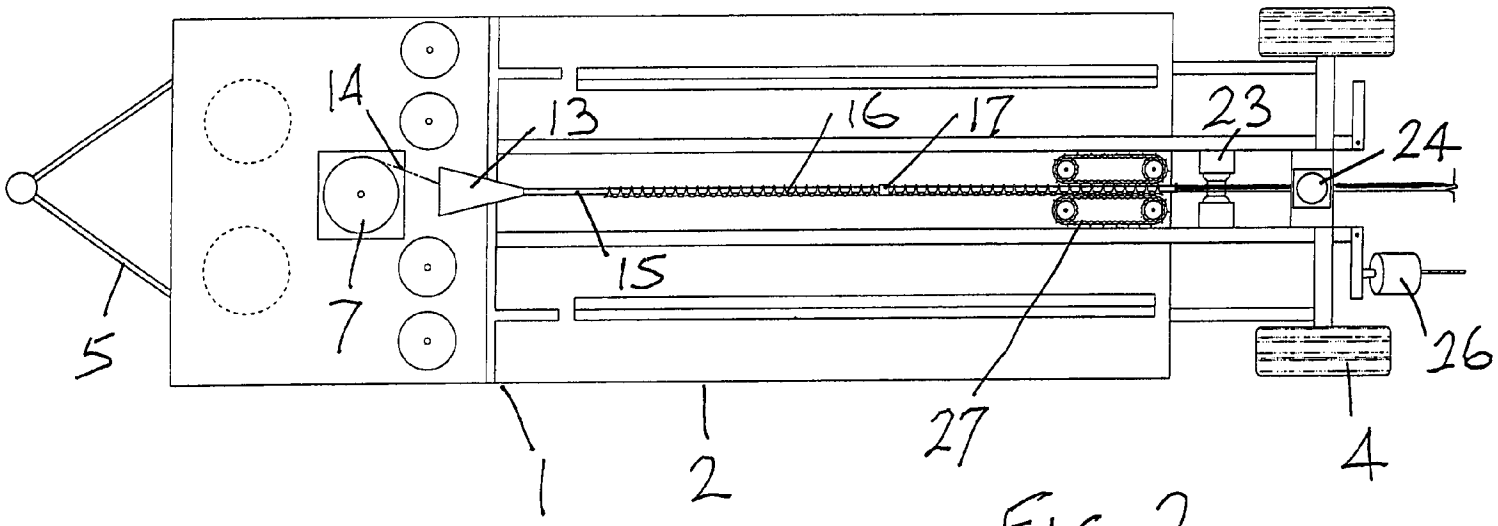
FIG. 2 is a view from above of the trailer portion of the apparatus as shown in FIG. 1.
Figure 3:
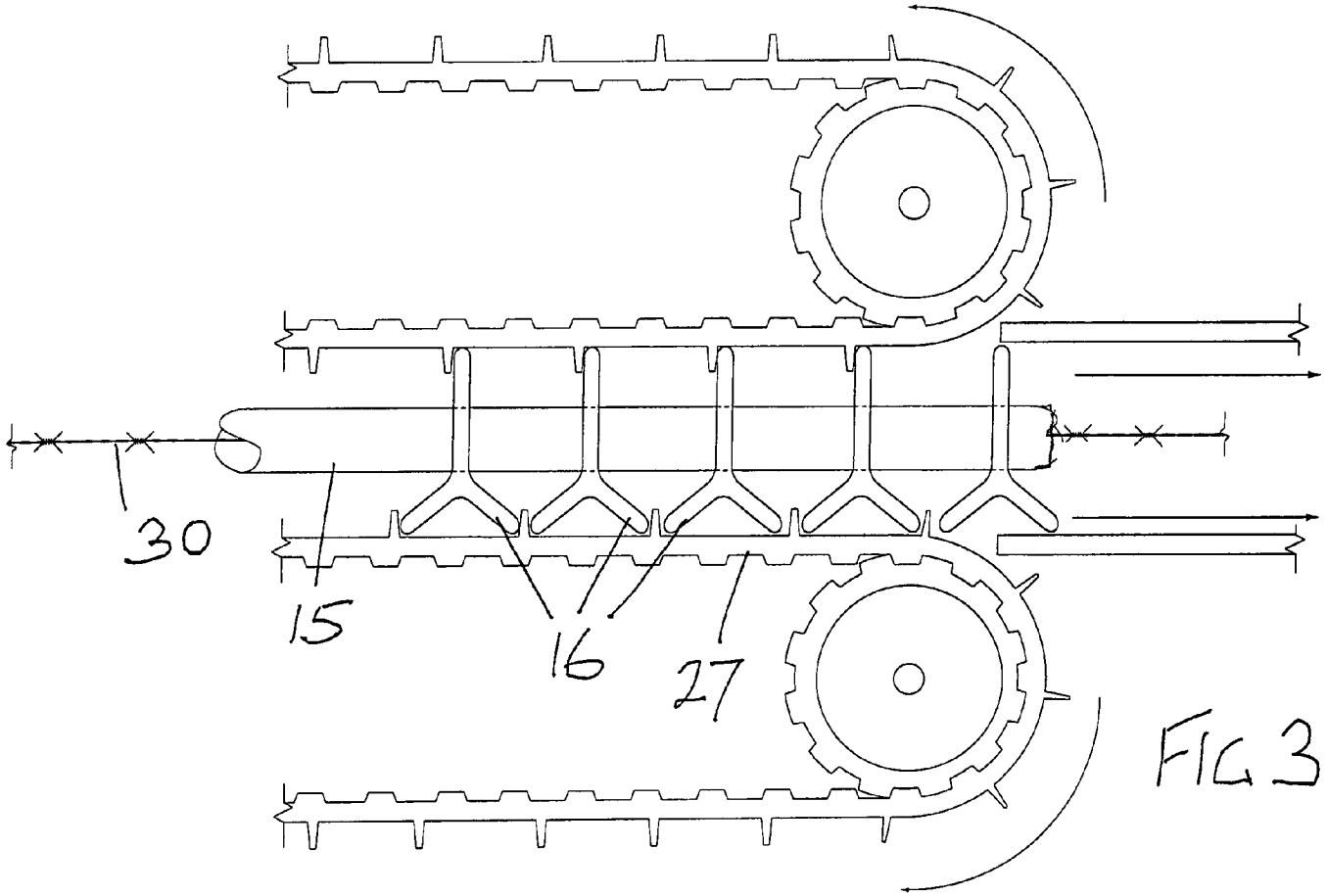
FIG. 3 is an enlargement of a portion of the apparatus as shown in FIG. 2 but in this case also showing barbed wire instead of plain wire passing through the respective conduit and posts.

Referring now to the drawings and particularly FIGS. 1 through 8 which is a first embodiment in detail there is a mobile apparatus 1 which in this case is in the form of a trailer including a platform 2, front steerable wheels 3 and rear fixed alignment wheels 4.

The steerable wheels 3 are attached to a draft frame 5 which is attached to a tractor 6.

The mobile apparatus 1 further includes a plurality of wire spool holders 7 which are held on a rotatable shaft which in turn is able to rotate but under a controllable braking pressure by means of brake 8.

In relation to each spool of wire carrier 7 there is shown in this case a spool of wire 9, 10, 11 and 12.

From each of these spools there is a cone guide shown typically at 13 which guides the wire 14 into a conduit 15.

This conduit passes mutually through a plurality of apertures in stakes which in this case are predominately star droppers at 16 but include from time to time a strainer post as at 17.

The star droppers 16 are supported mutually and in this case have further conduits at 18, 19 and 20.

The arrangement is such that these star droppers and anchor post at 16 and 17 can be moved or edged forward as a dropper at the end 21 is moved to an insertion station 22.

In order to reach the insertion station 22, guide rollers at 23 are arranged to be withdrawn. Dropper 21 can pass thereby into the station location 22 where there is a hydraulic ram 24 and means to affect a pressure from an upper end against the dropper 21 to urge this into the ground. While one arrangement is shown here an alternative arrangement provides for the dropper or other post to be moved horizontally past the guide rollers while withdrawn and then realigned below respective wires before the post is moved to the ground insertion station.

From there, wires are held under tension and extend to the last inserted dropper 25 and thereafter to an anchor or strainer post which is not shown.

On the apparatus at 26 there are means to effect an insertion and drilling of helical ground anchors to establish a strainer post for an end of the wires or for a strainer position somewhere along the length of the wires where the wires are captured to control the extent of the free length of any wire.

There is a conveyor system 27 arranged to inch the respectively droppers 16 or a strainer post forward and there is also a conveyor belt system such as is shown at 28.

The wire that can be used in this application can be varied to be appropriate for different applications.

Figure 4:
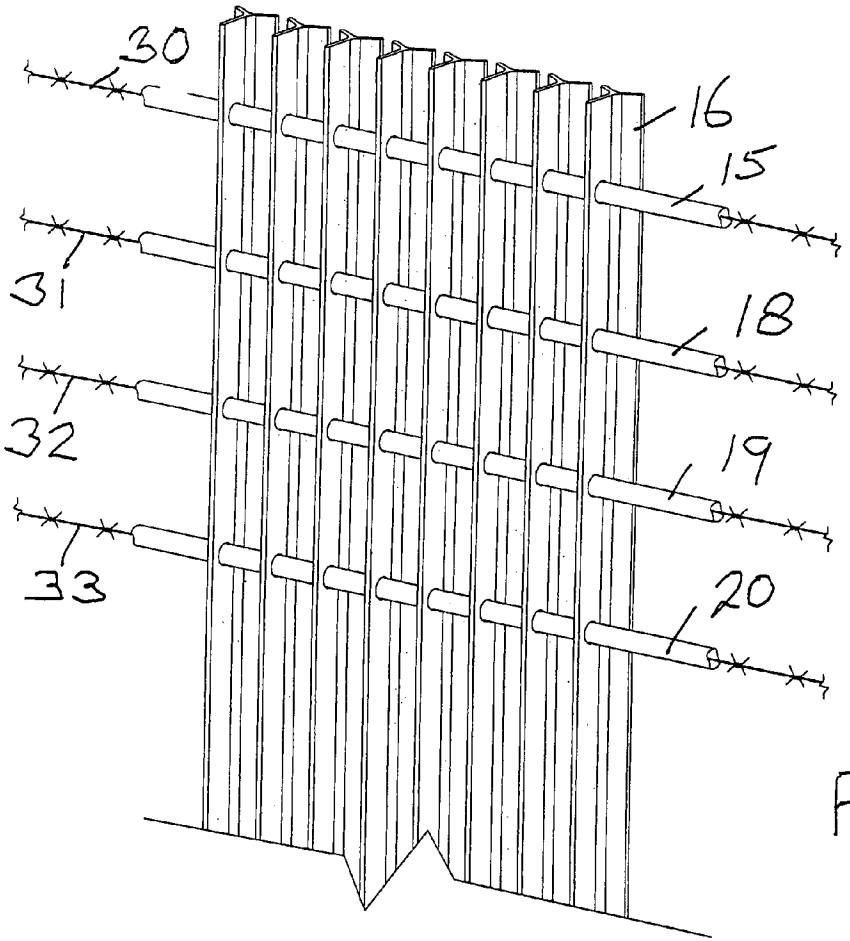
FIG. 4 illustrates the manner in which a plurality of star droppers are held collectively with in this case a conduit passing through each set of mutually aligned apertures in the respective droppers.
Figure 5:
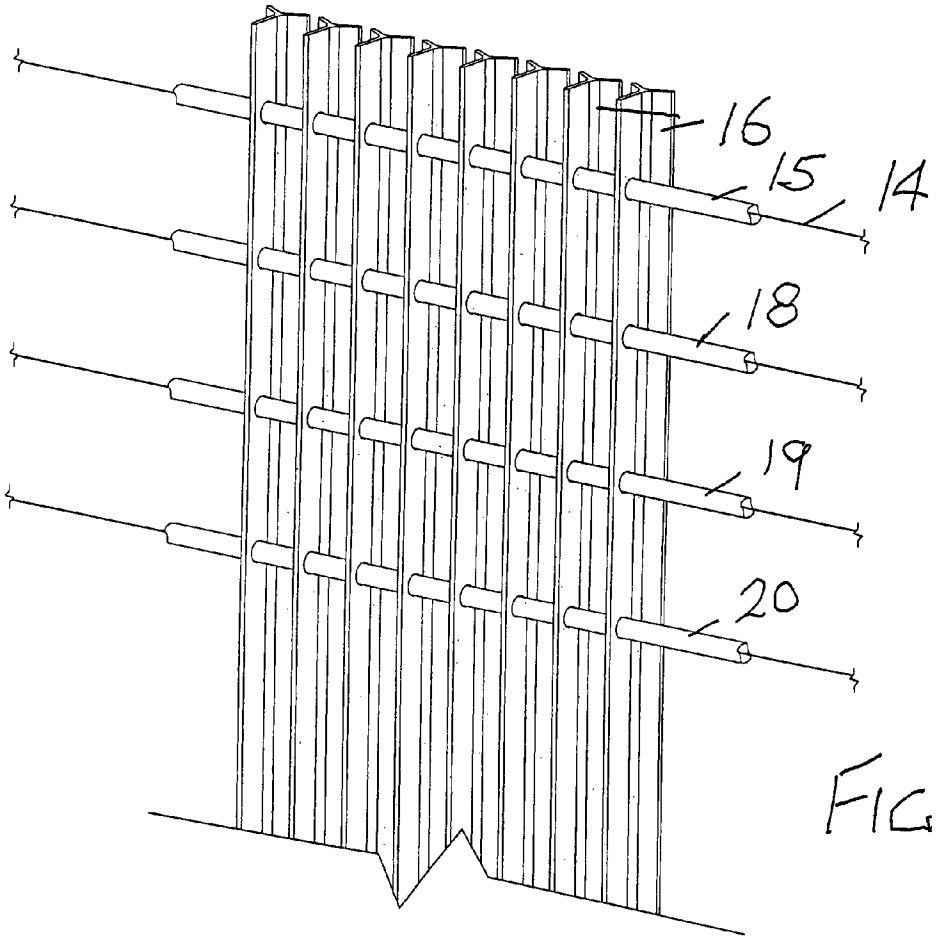
FIG. 5 is in a sense the same view as in FIG. 4 except in this case it is plain wire.
Figure 6:
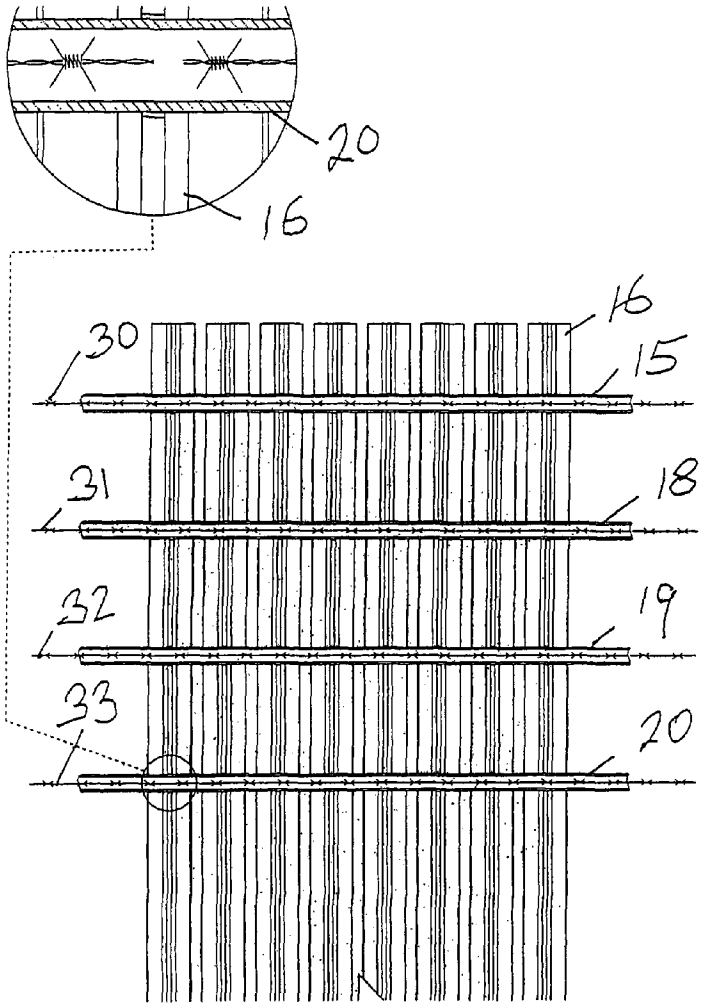
FIG. 6 is a side elevation rather than a perspective as in the case of FIGS. 4 and 5 and showing the common conduit holding respective star droppers in mutual alignment with a plurality of barbed wire passing through the respective conduits.
Figure 7:
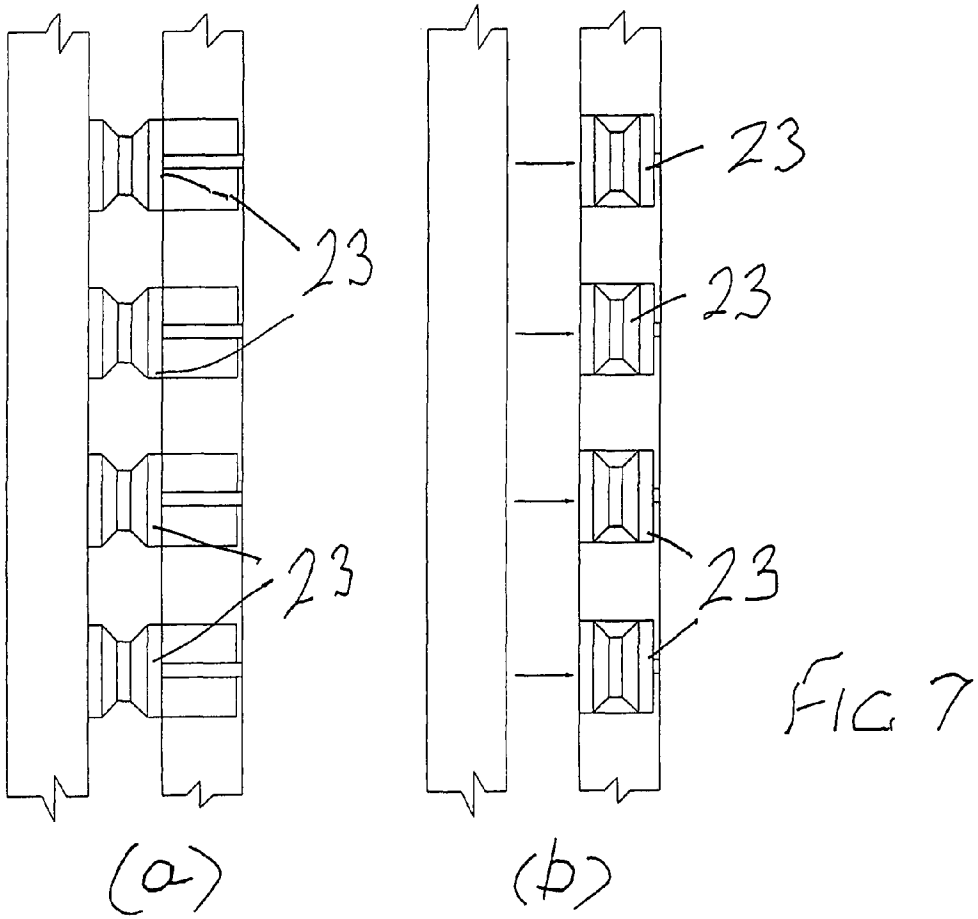
FIG. 7 illustrates a way in which the wire is guided in one instance but then the guide rollers are retracted to allow for a stake to be withdrawn from the set of stakes or posts or in this case star droppers.
Figure 8C:
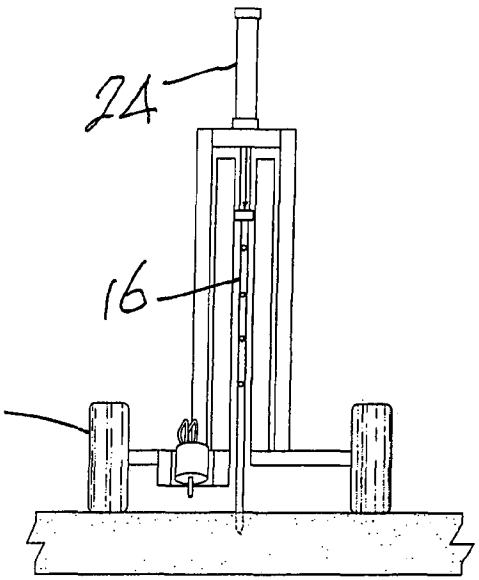
FIGS. 8(*a*), (*b*) and (*c*) shows in sequence action to effect an insertion of a star dropper at an insertion station.
Figure 8B:
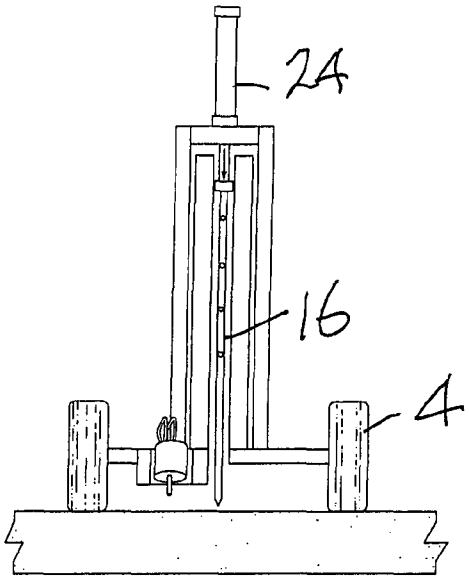
Figure 8A:
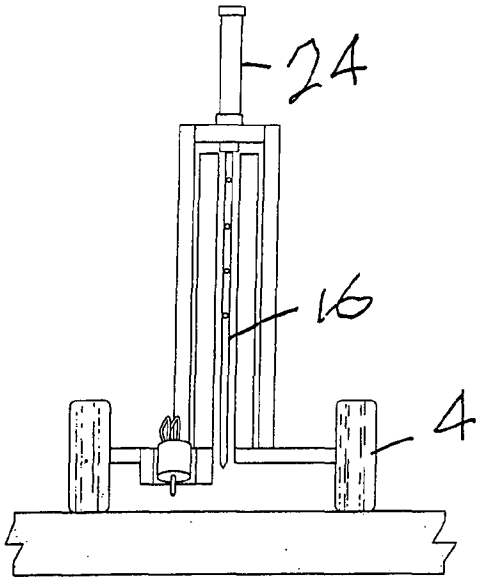

In FIG. 6 for instance there is shown four wires which are barbed shown at 30, 31, 32 and 33 which are also shown at FIG. 4 while the application shown in FIG. 5 shows conventional plain wire.

These wires and others can of course be variously selected and it is not intended that the application should be limited to any form of specific wire or even wire-like material.

Not shown specifically is a program and an automatic controller which receives global positioning signals and is able to correlate with respect to the actual position of the apparatus.

Further in the program there are means to effect detection of previously input data relating to chosen spacings between posts and also a direction of movement.

In a practical embodiment of this arrangement, there is also a person who is able to monitor on a direct basis the movement of the equipment and its operation and can interrupt this at any time so as to correct a malfunction, allow for re-programming of the computer in terms of directional spacing or indeed vary this from referencing this from a global positioning signal to absolute readings which include distance travel and direct travelled directly.

In estimates made so far, it is seen that the equipment will provide the potential for very rapid installation of fencing in circumstances which can seriously reduce the potential cost of such fencing both because of the number of people needed, and the construction method meaning that people do not have to go back repeatedly to perform tying of wire to stakes or other functions.

While a reference has been made to "an aperture" in a post, it is also envisaged that this can be the equivalent of an aperture in so far as an aperture could be defined and trap a wire when the stake or post is in one orientation, but allow the wire or stake to be relatively separated with a stake or post being in another orientation.

Figure 9:
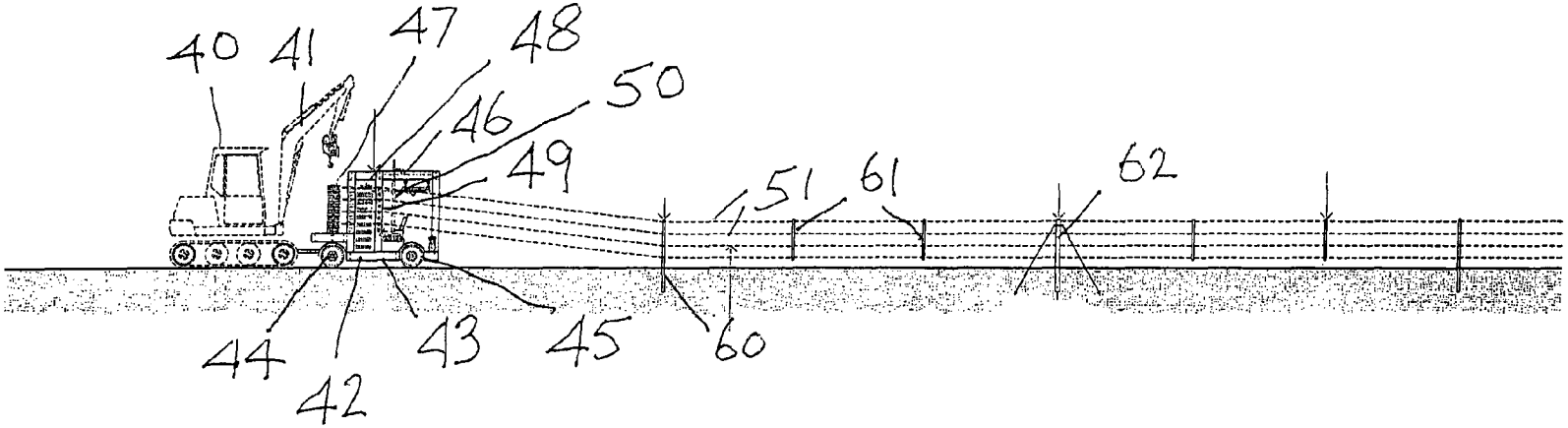
FIG. 9 is a side view of a second embodiment illustrating both an apparatus and fence being constructed extending from the apparatus.
Figure 10:
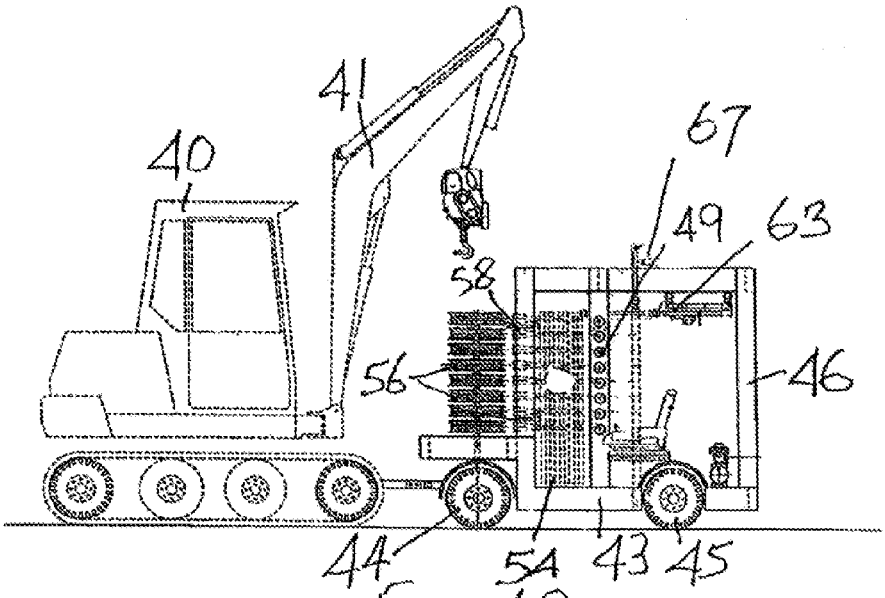
FIG. 10 is an enlarged view from the side of the embodiment being the second embodiment of the apparatus.
Figure 11:
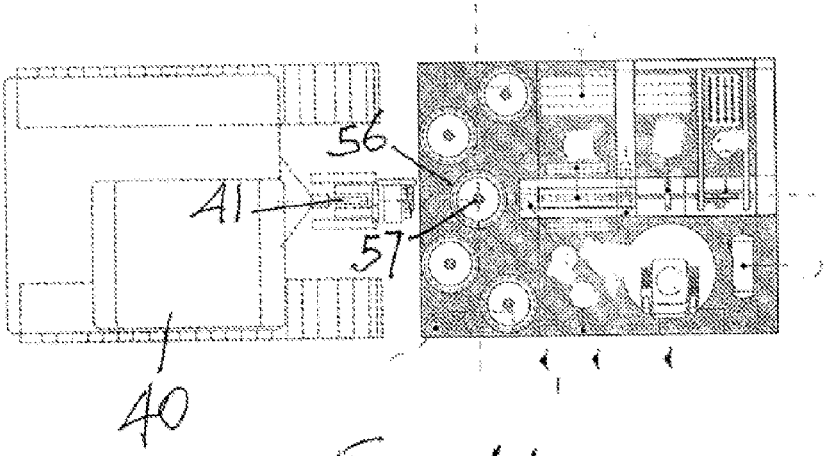
FIG. 11 is a plan view of the apparatus with the crane being retracted for clarity of the drawing, FIG. 12 in cross section along the line A in FIG. 10.
Figure 12:
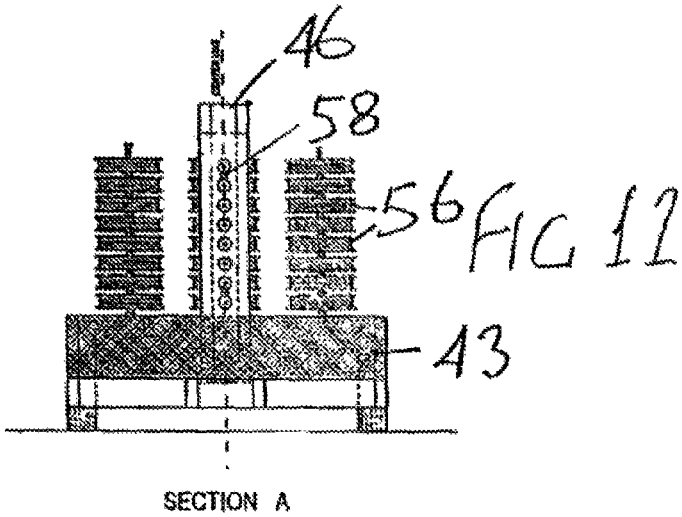
Figure 13:
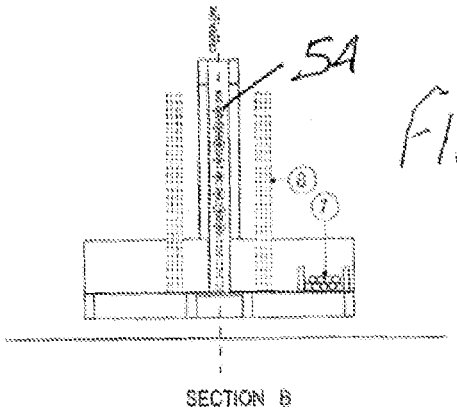
FIG. 13 is a cross sectional view along the line B in FIG. 10.
Figure 14:
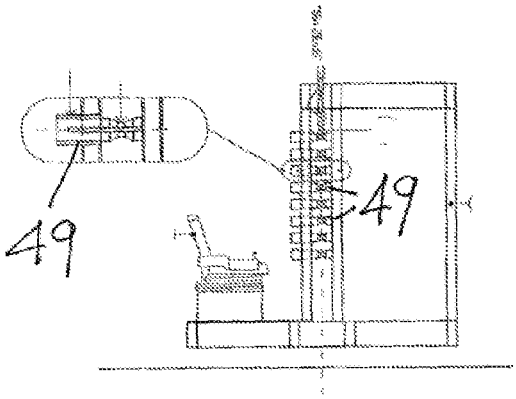
FIG. 14 is a view along the line C in FIG. 10.

Referring now in detail to a further embodiment shown from FIG. 9 and thereafter the apparatus in this case includes a prime mover 40 which includes a crane 41 and which is tethered to a trailer 42.

The trailer 42 includes a body 43 which is supported for ground engagement by steerable wheels 44 and rear fixed alignment wheels 45.

The body 42 supports a super structure 46 which, in principle, supports wire spool carriers 47 at a spool supporting station 47*a*, a post supporting station 48, a set of guide rollers 49 and a post embedding apparatus 50.

Each of these spools of wire 47 at the spool supporting station 47*a* are controlled by a braking apparatus whereby tension can be maintained at a selected minimum level so that wires shown generally at 51 can be tensioned and kept under such tension as they are allowed to wind out from the apparatus.

Figure 15:
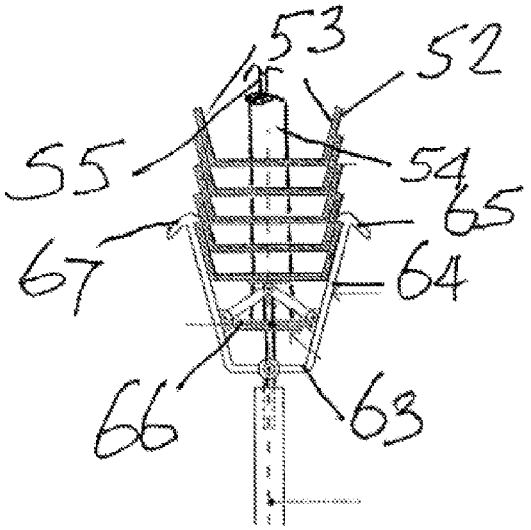
FIG. 15 is a view and plan of a set of the posts in this case being channels with flared sides and there being shown in this view a capture head arranged to capture and draw from its nesting position a post.
Figure 16:
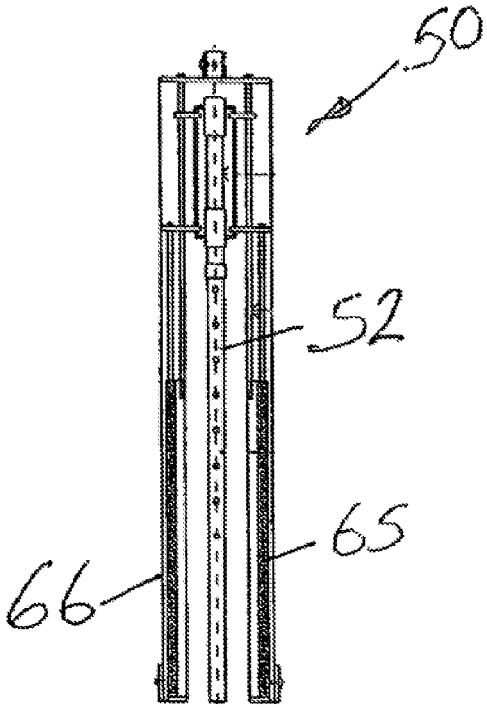
FIG. 16 is a view of a pneumatic ground embedding apparatus.

In this embodiment each of the posts 52 is in the form of a channel a cross sectional view of which is shown in FIG. 15 where sides 53 are flared so as to facilitate nesting one within the other so as to facilitate both storage and assistance in maintaining alignment.

The posts 52 in the form of channels are each threaded onto conduits 54 through which a wire shown typically at 55 will pass.

A plurality of wire spools 56 are supported on a vertical shaft 57 and are constrained against rotation by a braking system which is not shown but which ensures that there is an adjustable tension required until the tension on respective wire reaches a desirable minimal level.

The wire from each spool is fed through a cone shown typically at 58 then into conduits 54 which pass through each of correspondingly positioned holes in the set of channels.

The set of guide rollers 49 which are also arranged to be retractable are located so that wire 55 coming through the conduits 54 will ride over the respective rollers when they are in a working position and from there the wire will feed as is shown specifically in FIG. 9 from the apparatus to the respective embedded posts such as at 60 or through the separating stays such as 61.

A strainer post 62 will be positioned at spaced intervals along the length of a fence to be built and details of the strainer post will be given shortly.

While the drawing in FIG. 9 shows typically four wires, it is an option to use more or less wires and in this embodiment, there are shown eight spools and potential therefore for eight wires with corresponding apertures in correspondingly positioned channels.

The respective channels 52 are held in a nested position at the post supporting station 48 and a grab apparatus 63 is used to extend rearwardly with a head 64 which includes engaging fingers 65 which are spring loaded by spring 66 and outer ends of the fingers 65 at 67 are inclined so that when the head 63 is projected forwardly, it will encounter a closest channel and engage its outer edges and by gripping it, then pull it rearward past the then retracted rollers 49 and into the ground embedding station 50.

The apparatus is arranged so that upon the channel being in the retained position at the embedding station 50, there are means to activate pneumatic rams 68 and 69 and in this way, when properly positioned along the length of an intended fence line, embed either the separator stay as in 61 or a channel as in 60 or a strainer post.

Vertical alignment of the embedding station is controlled by a ram 68.

Once a post 52 is embedded, the forward travel of the apparatus is continued until a next position where it is stopped, and a next post then driven into the ground.

From time to time a strainer post will be required and for this a ground anchor is chosen and is screwed into the ground.

The invention can also reside in a post having a channel shape in cross section with flared sides.

The invention claimed is:

1. A mobile apparatus for assisting in building a fence, the apparatus having:

a support frame;

a spool of wire carrier supported by the support frame;

a post support station on the support frame supporting a plurality of posts with each post being adjacent one to the other and in a substantially parallel alignment to each other, each post having a first hole through the respective post, the support station arranged to hold each of the plurality of posts so that the first hole of each post is in a location relative to an adjacent post which allows for a matching location so that said first holes are mutually aligned;

a first length of wire, a portion of which is wound as a spool and carried by the spool of wire carrier and a further portion of which extends from the spool to pass through each of the aligned first holes of the plurality of posts;

an into-the-ground driving station on the support frame and including a post driver, said post driver driving posts into the ground when positioned in said into-the-ground driving station; and a grab apparatus having a head with fingers, the grab apparatus movable such that the fingers engage and grip one of said plurality of posts and move the post from said post support station into said into-the-ground driving station, with a portion of the wire still positioned through the first hole in the post.

2. A mobile apparatus as in claim 1 wherein the plurality of posts are of generally U shape in cross section along at least most of their length.

3. A mobile apparatus as in claim 1 wherein the plurality of posts are of channel shape with sides defining the channel shape being flared to facilitate nesting of one such post into a second of such shaped and dimensioned post.

4. A mobile apparatus as in claim 1 wherein the plurality of posts each have a second hole and a second length of wire that is separate and distinct from said first length of wire is wound as a spool and carried by the spool of wire carrier and is associated with said second holes of said plurality of posts.

5. A mobile apparatus as in claim 4 where the first holes in the posts have a conduit passing therethrough, and the second holes in the posts have a conduit passing therethrough.

6. A mobile apparatus as in claim 1 where the first holes in the posts have a conduit passing therethrough through which the further portion of the first length of wire extends.

7. A mobile apparatus as in claim 1 where the first length of wire is allowed to unwind from its spool subject to a selected minimum tension release.

8. A method of assisting in building a fence which includes a mobile apparatus having a support frame, at least one spool of wire carrier supported by the support frame, a post support station supported on the support frame and arranged to support a plurality of posts with each post being adjacent one to the other and being supported so that at least one aperture through each post is mutually aligned with other apertures in adjacent posts, and there is a portion of wire extending from a spool of wire supported by the spool of wire carrier which portion of wire extends through the mutually aligned apertures of the respective posts, the method including the steps of moving a post from the post support station to an insertion station on said support frame, said insertion station including a post driver, said post driver effecting an insertion of the post into the ground while the wire or wires remain threaded through the respective aperture or apertures of the post, and then moving the mobile apparatus to a next post insertion location.

9. A fence constructed in accord with the method of claim 8, wherein a length of wire threaded through an adjacent plurality of posts inserted into the ground is not captured by or at the respective apertures of that adjacent plurality of posts.

10. A mobile apparatus for assisting in building a fence, the apparatus having:

a support frame;

a spool of wire carrier supported by the support frame;

a post support station on the support frame supporting a plurality of posts with each post being adjacent one to the other and in a substantially parallel alignment to each other, each post having a first hole through the respective post, the support station arranged to hold each of the plurality of posts so that the first hole of each post is in a location relative to an adjacent post which allows for a matching location so that said first holes are mutually aligned;

a first length of wire, a portion of which is wound as a spool and carried by the spool of wire carrier and a further portion of which extends from the spool to pass through each of the aligned first holes of the plurality of posts; and an into-the-ground driving station on said support frame, said into-the-ground driving station including a post driver, said into-the ground driving station receiving each post with a portion of the wire still positioned through the first hole in the respective post, and said post driver driving posts into the ground when positioned in said into-the-ground driving station.

11. A mobile apparatus as in claim 10 wherein the plurality of posts are star droppers providing flanges in a star cross-sectional shape meeting at a centre, with one of the flanges of the star cross-sectional shape extending out further from the centre than its other two flanges.

* * * * *